United States Patent [19]

McGovney et al.

[11] Patent Number: 4,569,168

[45] Date of Patent: Feb. 11, 1986

[54] SELF-ELEVATING SUBSTRUCTURE FOR A PORTABLE OIL DERRICK

[75] Inventors: William E. McGovney, Kansas City, Mo.; Walter E. Garich, Salem, Ill.

[73] Assignee: P J Repair Service, Inc., Salem, Ill.

[21] Appl. No.: 419,761

[22] Filed: Sep. 20, 1982

[51] Int. Cl.[4] ..... E04D 15/00

[52] U.S. Cl. ..... 52/122.1; 52/109; 52/126.1; 182/148

[58] Field of Search ..... 52/126.1, 126.5, 126.3, 52/122.1, 123.1, 120, 109; 182/141, 148, 63; 254/4 C

[56] References Cited

U.S. PATENT DOCUMENTS

| | | | |
|---|---|---|---|
| 2,818,567 | 1/1958 | Oliver | 182/141 |
| 2,826,461 | 3/1958 | Eliason et al. | 304/29 |
| 2,974,929 | 3/1961 | Day | 254/4 |
| 3,416,267 | 12/1968 | Maniu | 52/121 |
| 3,593,481 | 7/1971 | Mikulin | 52/632 |
| 3,807,109 | 4/1974 | Jenkins | 52/120 |
| 4,405,116 | 9/1983 | Eisenberg | 182/141 |

FOREIGN PATENT DOCUMENTS

| | | | |
|---|---|---|---|
| 389808 | 7/1908 | France | 182/141 |
| 6708513 | 12/1968 | Netherlands | 52/126.5 |
| 92425 | 9/1958 | Norway | 182/148 |

*Primary Examiner*—Henry E. Raduazo
*Attorney, Agent, or Firm*—D. A. N. Chase; Michael Yakimo, Jr.

[57] ABSTRACT

A substructure for an oil derrick comprising a base frame, a top frame and an intermediate bifurcated support frame consisting of a pair of horizontally extending traveling frames. A linkage network of swingable leg members intercouples the base, traveling and top frames for movement in parallelism between collapsed and elevated conditions of the substructure. In the collapsed mode the frame members are positioned in an adjacent relationship for presenting a low profile to a flatbed truck which allows a portable oil rig to be easily shifted onto the top frame and into alignment with the oil wellhead therebelow. A block and tackle assembly operably engages the traveling frames and is coupled to the derrick hook carried by the traveling block of the oil derrick. Upon operation of the latter the swingably mounted traveling frames move towards each other causing an elevation of the top frame so as to present a working space between the elevated oil derrick and oil wellhead. The traveling frames are locked one to the other to maintain the top frame at its elevated position with collapsible end sway braces precluding lateral shifting of the top frame and oil rig thereon. To relocate the rig at another site, the traveling frames are unlocked causing a load induced, downward movement of the swingable leg members and associated frames toward their collapsed position with a hydraulic buffer assembly regulating the speed of movement of the traveling frames and thus the collapsing speed of the entire substructure.

24 Claims, 16 Drawing Figures

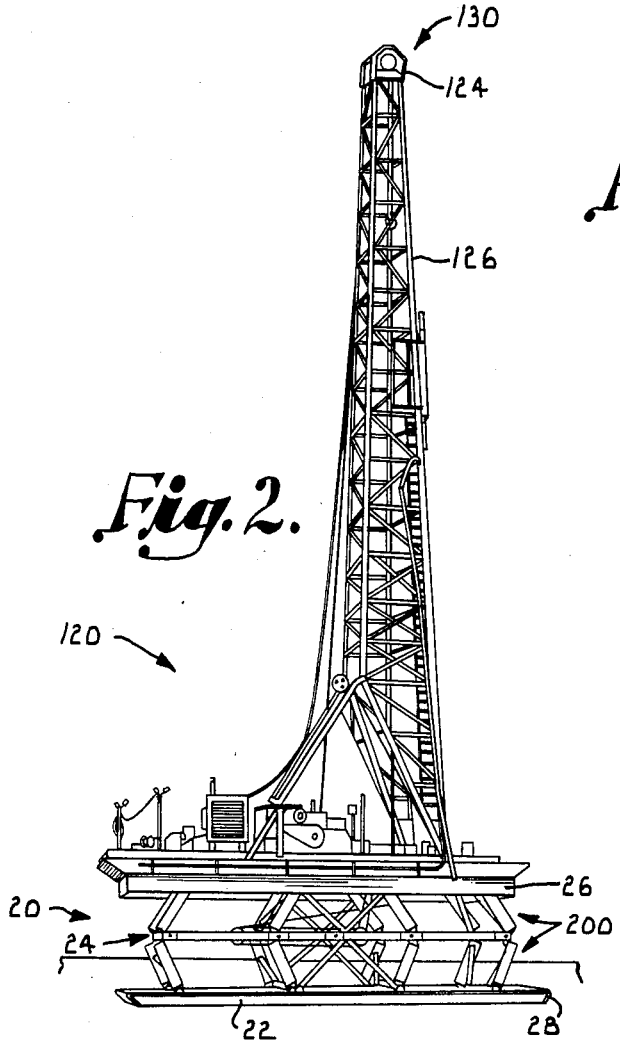
Fig. 2.
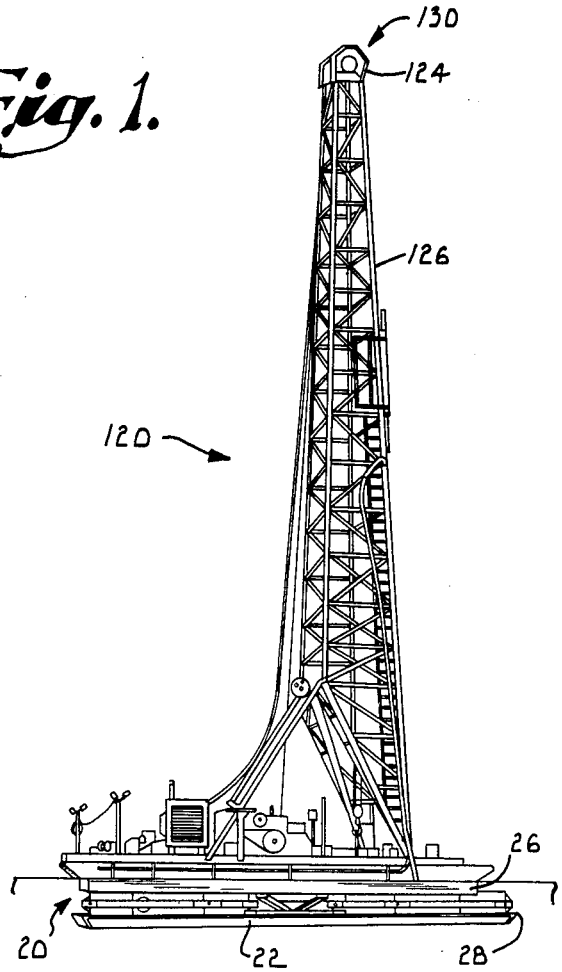
Fig. 1.
Fig. 3.
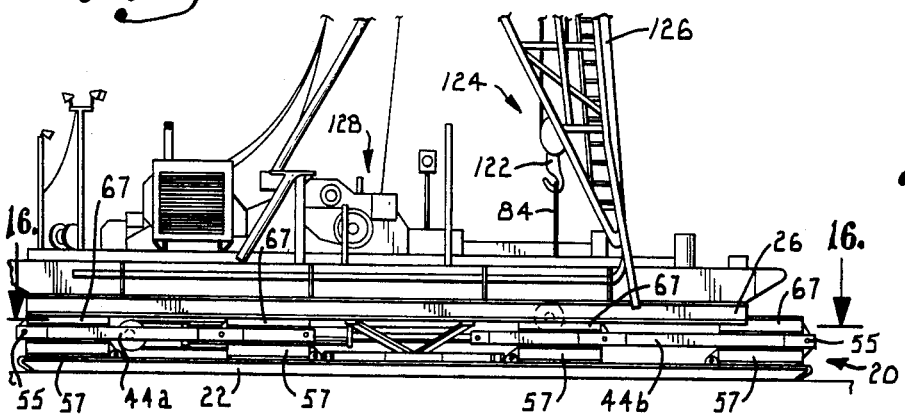
Fig. 4.
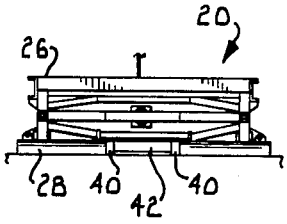

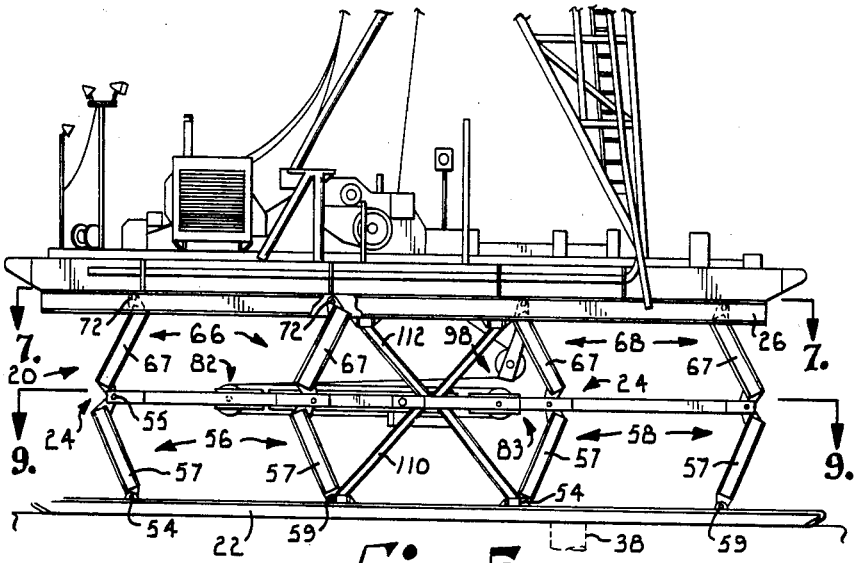
Fig. 5.
Fig. 6.
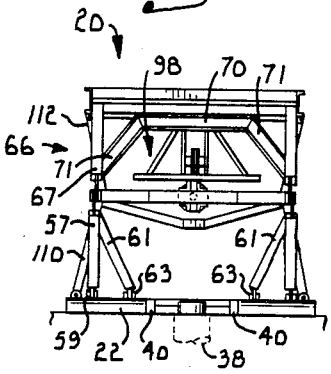
Fig. 7.
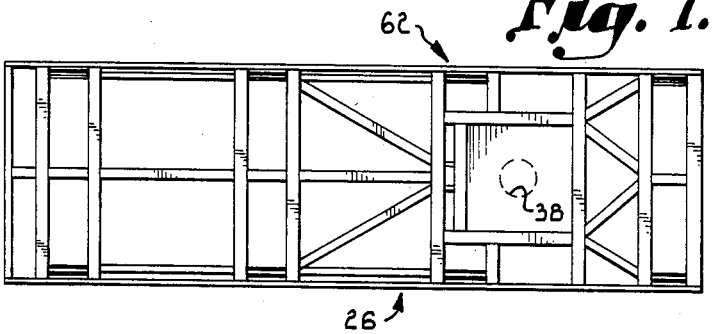
Fig. 8.
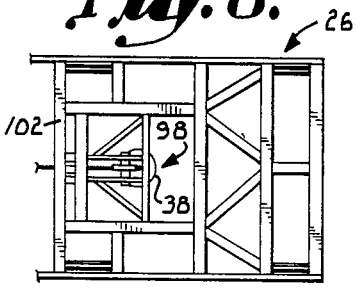
Fig. 15.
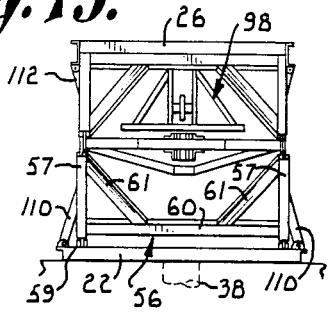
Fig. 9.
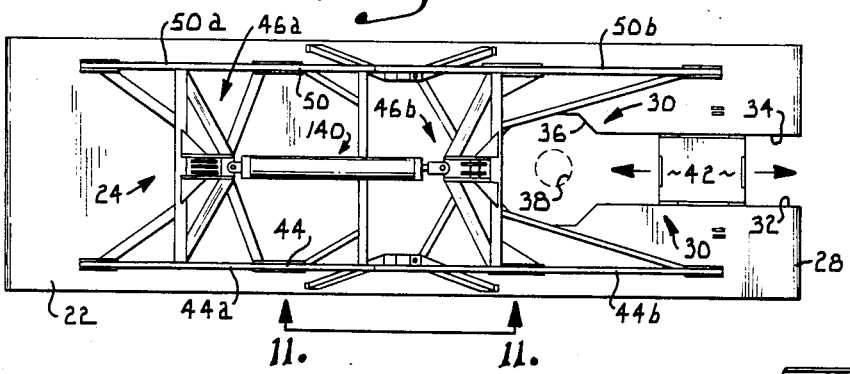
Fig. 11.
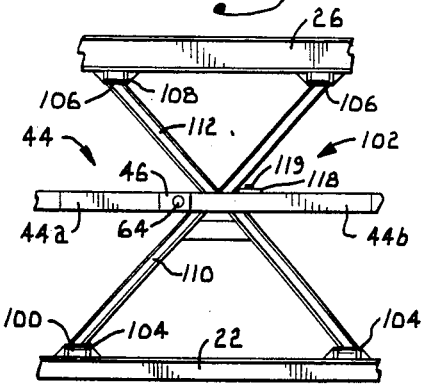
Fig. 10.
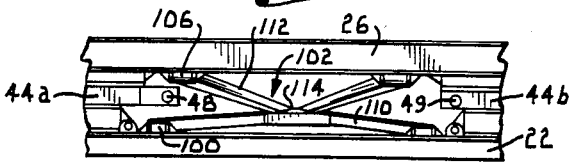

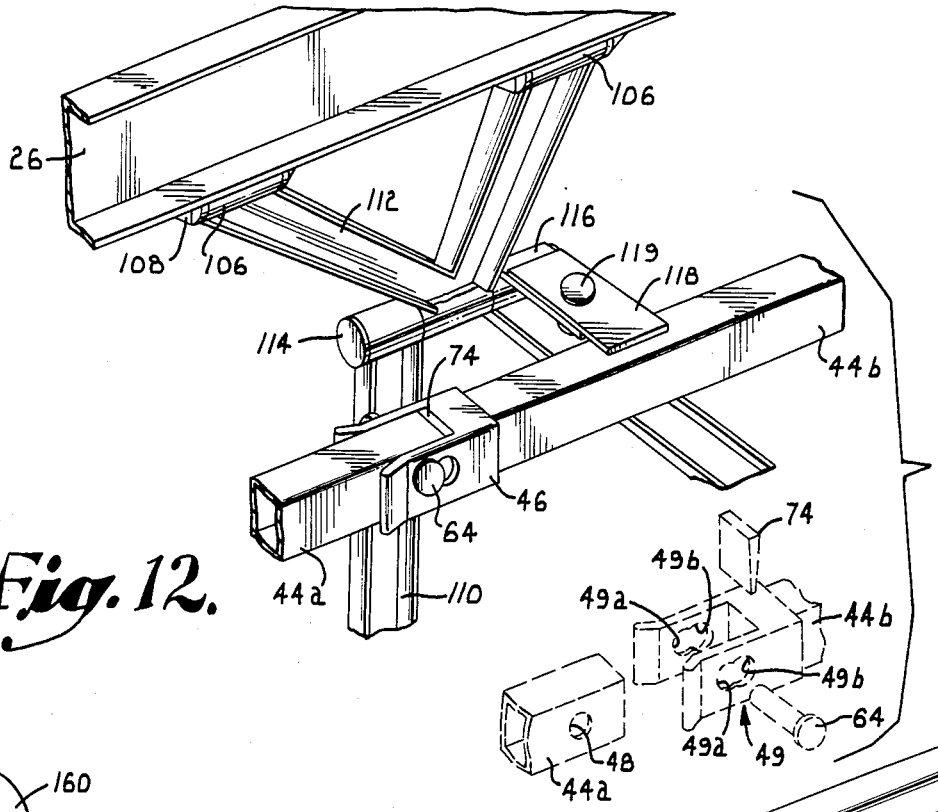
Fig. 12.
Fig. 14.
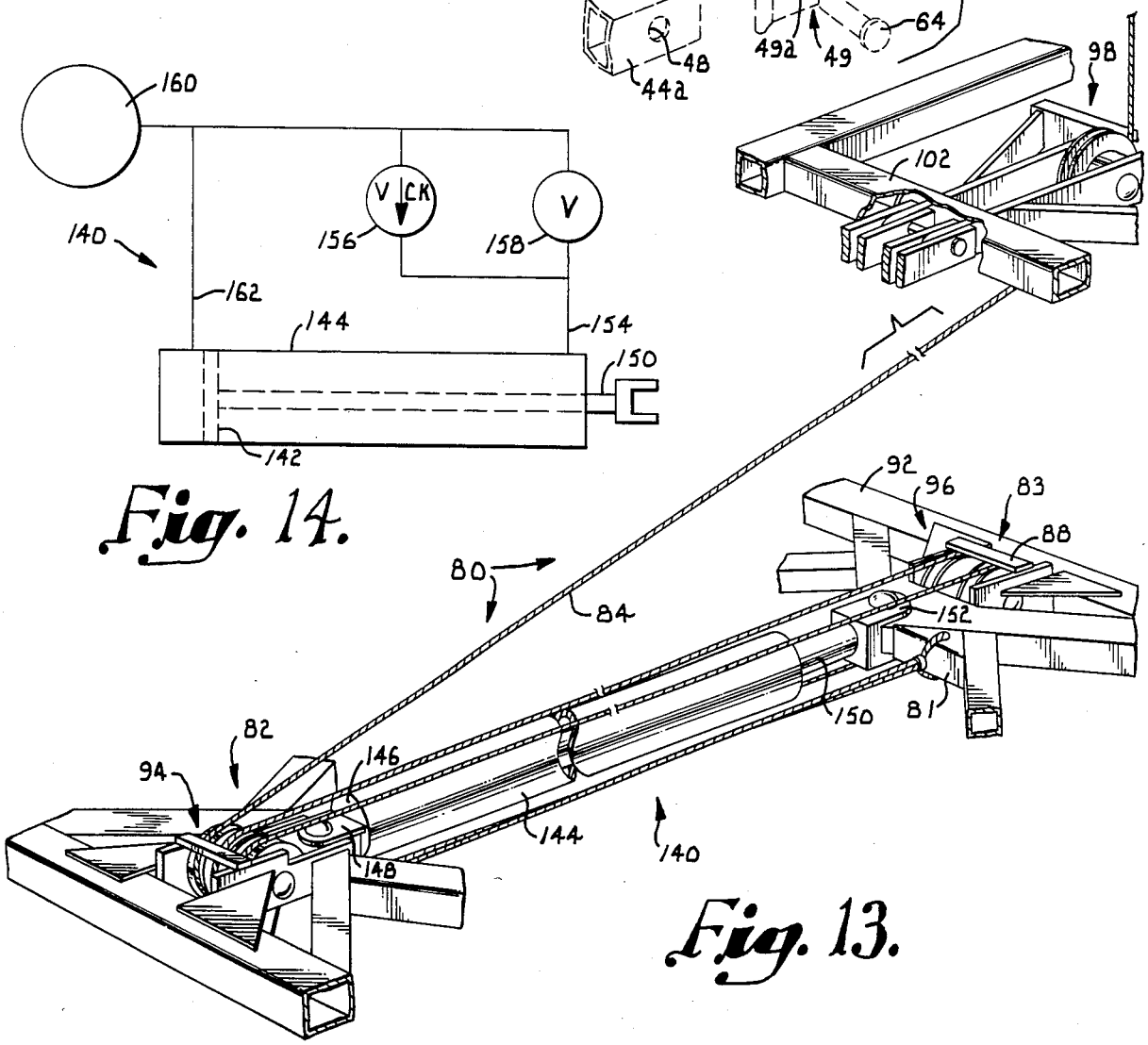
Fig. 13.

SELF-ELEVATING SUBSTRUCTURE FOR A PORTABLE OIL DERRICK

BACKGROUND OF THE INVENTION

This invention relates to load elevating devices, and more particularly to an oil rig lift having a supporting substructure operably powered by the rig for movement from a collapsed, oil rig loading position to an elevated, oil rig supporting position.

In the oil field it is desirable to elevate the base of the oil derrick from the ground in order to provide a work area under the base allowing for installation of necessary valves, fittings, blowout preventers, etc. about the oil wellhead. Early on such a work area was provided by a reinforced cellar dug about the wellhead with the derrick floor then forming a ceiling of this cellar. Another method included placing a fixed elevated platform above the oil wellhead to allow the crew working access under the elevated oil rig. The platform utilizes a fixed supporting substructure comprising a plurality of box-like sections of heavy steel girders and braces with each section being bolted one to the other at the wellhead location. Notwithstanding the time, trouble and expense of such platform assembly it is still necessary to properly position the oil rig/derrick on the elevated platform—a difficult and dangerous job considering the tremendous derrick weight.

In response to the desire for efficient movement of the entire oil rig from location to location, portable oil rig assemblies including the derrick and attendant machinery are in use today. However, there still remains the problems of efficiently elevating the portable oil rig to a position above the oil wellhead in a manner to assure a proper alignment of the oil derrick with the wellhead therebelow. One response has been a collapsible substructure having a top frame positioned at an initial relatively low profile upon which the oil rig/derrick is placed. Once the rig/derrick is in place the entire top frame is laterally shifted and simultaneously elevated to position the derrick above the wellhead. However, the lateral displacement of this top frame with the significant oil rig load thereon for alignment above the wellhead raises the problem of lateral load shifting and limits the ability to easily achieve a required vertical alignment of the derrick with the wellhead disposed therebelow.

In response to these problems we provide a substructure, having collapsed and elevated modes, which is particularly adapted for supporting an oil rig with derrick thereon. The substructure utilizes a base mat with a wellhead aperture therein, a horizontal top frame positioned in a parallel relationship to the base mat and an intermediate, bifurcated frame comprising first and second traveling subframes therein. Linking the base mat, traveling frames and the top frame are a plurality of pivotal leg members swingable through vertically disposed arcs relative to the base mat therebelow. In the collapsed condition the traveling frames are in a longitudinally spaced-apart relationship and are generally horizontally adjacent the base mat. The top frame is also horizontally adjacent the traveling and base frames which presents a low profile to the substructure allowing for easy transfer of the oil well rig from a flatbed truck to the top frame. Upon transfer the oil derrick is aligned with the wellhead as presented through the wellhead aperture therebelow.

Operably associated with the traveling frames is a block and tackle arrangement utilizing a plurality of pulleys on each traveling frame with a steel cable trained therearound. Upon attachment of the free end of the cable to the derrick hook, operation of the oil derrick's block and tackle assembly operates the substructure's block and tackle which causes the traveling subframes to move one towards the other. In response to such longitudinal movement the plurality of pivotal leg members swing through their respective arcs which longitudinally shifts and vertically displaces the traveling frames and elevates the top frame with the derrick load thereon. The pivotal leg members, as connected in parallel between the base mat, each traveling frame and top frame, present a parallel linkage structure intercoupling the traveling and top frames so that the respective frames remain parallel during their movement.

Collapsible end sway braces are also employed and restrain the loaded top frame against longitudinal shifting to thereby confine the displacement of the top frame to strictly vertical movement. Once the traveling frames reach a side-by-side relationship they are locked together to present an intermediate support frame to the now fully elevated top frame. Accordingly, a working area is presented below the elevated derrick and about the oil wellhead allowing for installation of the necessary valves, blowout preventers and the like.

To lower the substructure preparatory to relocating the rig at another site, the traveling frames are unlocked and the weight of the oil rig itself urges the pivotal leg members to swing downward causing a concurrent downward movement of the top frame and traveling subframes towards their collapsed positions. A hydraulic piston/cylinder assembly regulates the downward movement so as to buffer the collapsing movement of the entire substructure. In its collapsed condition the oil rig is then easily shifted from the top frame to a flatbed truck known as an "oil field float" for site relocation. Moreover, the collapsed substructure itself requires only a single float for transport as a unit to another site with the assurance that the substructure loaded on the float will not interfere with overhead obstacles such as bridges, power lines and the like.

It is therefore a general object of this invention to provide a substructure for displacing a load between a first relatively ground adjacent position and a second elevated position.

Another general object of this invention is to provide a substructure, as aforesaid, in which said load is an oil rig including oil derrick and attendant machinery therein.

Still another general object of this invention is to provide a substructure, as aforesaid, which elevates the oil derrick from the relatively ground adjacent position to present a working space about the oil wellhead.

A still further general object of this invention is to provide a substructure, as aforesaid, in which the attendant machinery of the oil rig operably engages the substructure to lift the substructure and bootstrap the oil rig/load to the elevated position.

Another object of this invention is to provide a substructure, as aforesaid, which displaces said load strictly vertically without inducing any lateral movement.

Still another object of this invention is to provide a substructure, as aforesaid, which includes a pair of traveling frame members movable toward and away from each other to effect an upward and downward displacement of said load.

Still another object of this invention is to provide a substructure with traveling frames, as aforesaid, which utilizes a ground supporting base mat or frame and a load supporting top frame with said top frame being vertically displaced in response to said movement of said traveling frames.

Another object of this invention is to provide a substructure, as aforesaid, which utilizes linkage means intercoupling said top, traveling and base frames to cause the top and traveling frames to displace upwardly or downwardly in response to said traveling frame movement.

A further object of this invention is to provide a substructure with linkage means as aforesaid, in which said downward displacement of said traveling and top frames is induced by said load thereon.

Still another object of this invention is to provide a substructure with linkage means, as aforesaid, which maintains a parallel relationship among said frame members during movement thereof.

A still further object of this invention is to provide a substructure, as aforesaid, which utilizes end sway braces to preclude horizontal shifting of said load during elevating operation of the substructure.

Another object of this invention is to provide a substructure, as aforesaid, which utilizes a buffer assembly to control the downward movement of said frames and thus the collapsing movement of said substructure.

Still another object of this invention is to provide a substructure, as aforesaid, which utilizes a block and tackle to effect said movement of said traveling frames.

A further object of this invention is to provide a substructure with block and tackle, as aforesaid, which is engageable with the block and tackle of the associated oil rig to allow said oil rig to raise itself to the elevated position.

A still further object of this invention is to provide a low profile to said substructure, as aforesaid, during the collapsed mode thereof to allow for easy transfer of said oil rig from and to an adjacent transport vehicle.

A more particular object of this invention is to provide a substructure of a low profile, as aforesaid, transportable by a single vehicle as a unit between sites and without interference with overhead obstacles on the route therebetween.

Another object of this invention is to provide a substructure, as aforesaid, having an area in the base frame for surrounding the wellhead and allowing for transport of materials to and from the wellhead area.

Still another object of this invention is to provide a substructure, as aforesaid, which has a base frame therein with rail means thereon allowing for easy transport of materials to and from the oil wellhead.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 1 is a perspective view, from one side thereof, showing the substructure in a collapsed position with a portable oil rig thereon.

FIG. 2 is a perspective view showing the substructure of FIG. 1 in an elevated position.

FIG. 3 is a fragmentary elevational view, on an enlarged scale, showing the substructure in the collapsed position.

FIG. 4 is an end view of the substructure as shown in FIG. 3, taken from the right side thereof.

FIG. 5 is a fragmentary elevational view, on an enlarged view, showing the substructure in the elevated position.

FIG. 6 is an end view of the substructure as shown in FIG. 5, taken from the right side thereof.

FIG. 7 is a plan view, taken along line 7—7 in FIG. 5, and showing the top frame of the substructure.

FIG. 8 is a fragmentary plan view of the top frame, as shown in FIG. 7, and showing the associated swing sheave positioned in a horizontal relationship within the derrick receiving platform the top frame.

FIG. 9 is a plan view, taken along line 9—9 in FIG. 5, and showing the traveling subframes, associated block and tackle assembly and end sway braces in the elevated position with the pivot legs being removed for purposes of illustration.

FIG. 10 is a fragmentary elevational view of the substructure shown in FIG. 3, showing the collapsed mode of an end sway brace bridging the base mat and top frame.

FIG. 11 is a fragmentary elevational view, on an enlarged scale, taken along line 11—11 in FIG. 9, showing the end sway brace in the elevated position.

FIG. 12 is a fragmentary perspective view, on an enlarged scale, showing the interengagement and locking of the longitudinal beams of the adjacent traveling frames, and in phantom, the unlocked configuration of the same.

FIG. 13 is a fragmentary perspective view, on an enlarged scale, showing the block and tackle and buffer assemblies operably associated with the traveling frames and including the swing sheave assembly associated with the top frame.

FIG. 14 is a diagrammatic view showing the piston/cylinder and valve controlled fluid flow paths of the buffer assembly.

FIG. 15 is an end view of the substructure as shown in FIG. 5, taken from the left side thereof.

DESCRIPTION OF THE PREFERRED EMBODIMENT

Figure 16:
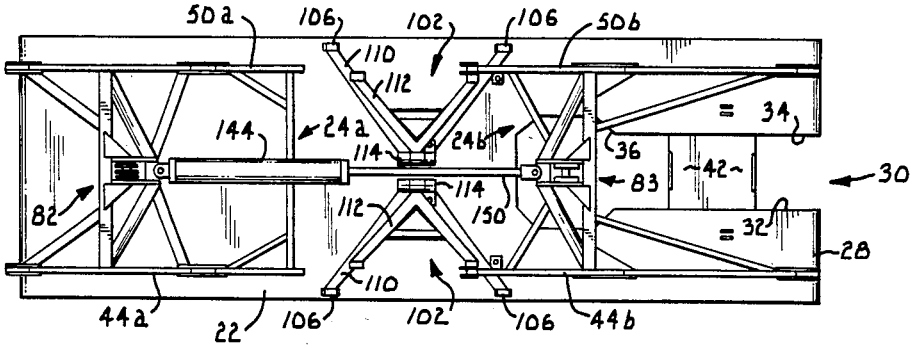
FIG. 16 is a plan view, taken along line 16—16 in FIG. 3, and showing the traveling frames, associated block assembly and end sway braces in the collapsed position with the pivot legs being removed for purposes of illustration.

Referring more particularly to the drawings the substructure/lift 20 generally comprises an elongated base mat 22, a top frame 26 and a bifurcated intermediate support frame 24 comprising first and second traveling frames 24*a*, 24*b*, all intercoupled by a parallel linkage network generally designated as 200.

The base mat 22 is generally rectangular in configuration and solid in construction so as to offer a substantially, rigid bottom for basal stabilization of the substructure 20. Longitudinally extending from one end 28 of the base mat 22 is a keyhole 30. The keyhole 30 presents a pair of laterally spaced-apart and longitudinally extending sidewalls 32, 34 with a wall 36 for encompassing the oil wellhead 38. Extending along each sidewall 32, 34 are channels 40 designed to functionally engage wheels of a low-profile cart 42 which provides transport of materials to and from the wellhead 38 area.

Located above the base mat 22 is the bifurcated, intermediate support frame 24. In its locked position the frame 24 (FIG. 9) is rectangular in configuration as presented by first and second laterally spaced-apart and longitudinally extending bifurcated beams 44 and 50. Each beam comprises first and second segments 44*a*, 44*b*, 50*a* and 50*b* with structural support 46*a*, 46*b* spanning therebetween to present the first and second traveling frames 24*a* and 24*b*. Bracket members 46 are welded to the interior ends of each beam segment 44*b*, 50*b* for reception of the adjacent ends of segments 44*a*, 50*a* and alignment of apertures 48, 49 allowing for insertion of two locking pins 64 therethrough. Each aperture 49 presents an oversized pin insertion slot 49*b* and a pin seat 49*a*. Upon insertion of each locking pin 64 through the corresponding slots 49*b*, as aligned with the intermediate apertures 48, the pins are urged into pin seats 49*a* by the tendency of the respective beam segments 44*a*, 44*b* and 50*a*, 50*b* to move in opposing directions. Locking wedges 74 are then positioned between the beam segments to eliminate play therebetween and thus provide a rigid connection.

Each traveling frame 24*a*, 24*b* is pivotally mounted to the base mat 22 by means of first and second longitudinally spaced-apart swing braces 56, 58. Each swing brace 56, 58 comprises a pair of laterally spaced-apart and upwardly extending leg members 57 pivotally mounted about a laterally extending, horizontal pin member 54 extending through brackets 59 mounted to the base mat 22. A lateral strut 60 connects the laterally opposed legs 57 of each brace 56, 58 with diagonal struts 61 extending between strut 60 and each laterally opposed leg 57 to provide rigidity thereto. The lateral strut 60 is omitted from the swing brace 58 adjacent the base frame end 28 to preclude interference with a load in the cart 42 as it moves along the keyhole 30. Accordingly, the diagonal struts 61 are pivotally mounted to end brackets 63 laterally adjacent brackets 59. The opposed ends of each leg 57 are pivotally mounted to a laterally extending horizontal pin member 55 extending through the beam segments 44*a*, 44*b*, 50*a* and 50*b*. Therefore, each brace 56 and 58 is swingable through a vertically disposed arc relative to the base mat 22.

Swinging movement of the braces 56 and 58 from a collapsed position, in which the legs 57 are in a generally horizontal position, and through their respective vertically disposed arc likewise moves the respective beam segments 44*a*, 44*b*, 50*a*, 50*b* and the associated traveling frames 24*a*, 24*b* and one towards the other. This shifting and elevating movement continues until the adjacent ends of each segment 44*a*, 44*b*, 50*a* and 50*b* engage the brackets 46 and present the alignment of the apertures 48, 49 therein through which locking pin 64 is inserted as above-described (FIG. 12).

Superiorly positioned relative to the traveling frames 24*a*, 24*b* and in a horizontal relationship therewith is the top frame 26. The top frame 26 is generally rectangular in configuration with supporting framework therein to provide a relatively lightweight but rigid support to the oil rig 120 thereon. At one end of the top frame 26 is a rectangular open platform 62 positioned in vertical alignment with the keyhole wall 36 surrounding the wellhead 38 therebelow. The top frame 26 is coupled to each traveling frame 24*a*, 24*b* by means of upper swing braces 66, 68 having a configuration similar to swing braces 56, 58. One end of each upper swing brace leg 67 is mounted about pivot pin 55 common to the leg 57 of the lower swing braces 56, 58 disposed therebelow. A lateral strut 70 and diagonal struts 71 are disposed between the laterally opposed legs 67 of each upper swing brace 66, 68 to offer structural rigidity thereto. The opposed ends of traveling frames 24*a*, 24*b* and base frame 22 operably responsive to movement of the traveling frames 24*a*, 24*b*. It is here pointed out that the respective leg members 57, 67, associated with each traveling frame 24*a*, 24*b*, are in a parallel relationship. This relationship presents a parallel linkage structure between the traveling and top frames which maintains a parallel relationship between the respective frame members during their movement.

A block and tackle 80, associated with the traveling frames 24*a*, 24*b*, is provided. The block and tackle comprises first 82 and second 83 block assemblies mounted to lateral struts 90 and 92 of each traveling frame by brackets 86, 88. One end of a wire rope/cable 84 is anchored to cross arm 81 with the rope then being serially wound about the three pulleys 94 in block 82 and the two pulleys 96 in block 83 as shown in FIG. 13. The free end of the wire rope 84 is then wound about a swing sheave 98 pivotally mounted to a cross member 102 of the platform 62 on the top frame 26. The swing sheave 98 is movable between a horizontal position centrally extending into the platform 62, as shown in FIG. 13, and a normal position inferiorly disposed to the top frame 26 as shown in FIG. 15.

A pair of laterally spaced-apart and collapsible end sway braces 102 is pivotally mounted to the base mat 22 about pin members 100 longitudinally extending through brackets 104 and to the top frame 26 about pin members 106 longitudinally extending through brackets 108. Each sway brace 102 comprises first and second A frame members 110 and 112 pivotally mounted about a longitudinally extending common pivot pin 114 at their adjacent apexes, as can be seen from an inspection of FIGS. 11 and 12. The longitudinally extending pivot pins 100, 106, 114 are normal to the laterally extending pivot pins associated with the swing braces 56, 58, 66, 68 for a purpose to be subsequently described.

OPERATION

In the collapsed position, as shown in FIG. 3, the respective upper 66, 68 and lower 56, 58 swing braces are in a generally horizontal relationship relative to their associated frame members. This relationship presents a low profile to the lift 20 in its collapsed state (4'4"—133 cms.) which allows the portable rig 120 to be easily shifted from a flatbed truck and onto the top frame 26. Upon proper placement the derrick 126 of the rig 120 is aligned atop the rectangular platform 62 which is in alignment with the wellhead 38 therebelow as framed by the wall 36 of the keyhole 30.

The swing sheave 98 in the horizontal position shown in FIG. 13 directs the free end of the wire rope 84 to the derrick hook 122 associated with the derrick's block and tackle assembly 124. Upon attachment the derrick winch 128 is activated which raises the free end of the wire rope 84 toward the crown 130 of the derrick 126. This cooperation of block and tackles 80, 124 presents an overall mechanically advantageous movement of the block assemblies 82, 84 and associated traveling frames 24*a* and 24*b* one towards the other and an accompanying movement of the swing braces 56, 58, 66 and 68. This traveling frame/swingable brace 56, 58 cooperation is translated into a longitudinal shifting and elevation of the traveling subframes 24*a*, 24*b* with such movement being terminated by the above-described engagement and locking of the longitudinally aligned segment 44*a*, 44*b*, 50*a*, 50*b* ends. Upon such locking the intermediate support frame 24 is presented.

Concurrent with the above traveling frame movement is a swinging movement of the upper swing braces 66, 68 which raises the top frame 26 with load 120 thereon. As above stated, the parallel linkage structure 200 maintains the top frame 26 parallel to the base mat 22. Thus, the alignment of the derrick supporting platform 62 and oil derrick 126 thereon with the wellhead 38 therebelow is also maintained.

Concurrent with the elevation of the top frame 26 is an unfolding of the end sway braces 102 from their collapsed position. These braces 102 preclude longitudinal displacement of the top frame 26, as assisted by the orthogonal relationship of the bracketed pivot pins 100, 106, 114 with the lateral axis of the top frame 26 and the laterally extending pivot pins of the upper and lower swing braces. Upon full elevation the locking plates 116 on each common pivot pin 114 are brought into contiguity with the locking plates 118 on each beam segment 44*b*, 50*b* allowing for insertion of locking pins 119 through the apertures therein. This locking mechanism stabilizes the end sway braces 102 at their elevated position.

Thus, the substructure/lift 20, as above-described, enables the oil rig 120/derrick 126 to lift or "bootstrap" itself to a raised position (12'0"—3.6 m.) with no longitudinal or lateral shifting of the tremendous rig load (approximately 125,000 lbs.) from its initial position aligned with wellhead 38.

Prior to site relocation, the locking wedges 74 and pins 64, 119 are removed. The weight of the oil rig 120 cooperates with the geometry of the respective swing braces 56, 58, 66, 68 to induce downward swinging and thereby effect a novel self-starting of the shifting and downward movement of the now unlocked traveling frames 24*a*, 24*b* and a concurrent downward movement of the top frame 26 to their collapsed positions as shown in FIG. 3.

To control the speed of the collapsing movement of the substructure 20, a buffer assembly 140 is provided. This assembly 140 comprises a hydraulic piston 142/cylinder 144 combination with one end 146 of the cylinder 144 being mounted to traveling frame 24*a* by means of a bracket 148. The end of the piston rod 150 is mounted to traveling frame 24*b* by means of bracket 152 as shown in FIG. 13.

A hydraulic system is provided as diagrammatically shown in FIG. 14. During movement of the traveling frames 24*a*, 24*b*, one towards the other only a minimal fluid pressure is presented to the path of the piston 142 through the cylinder 144. During such forward movement (to the left in FIG. 14) of the piston 142 the fluid enters cylinder 144 via line 154 through a check valve 156. Upon collapsing movement of the traveling frames 24*a*, 24*b* the hydraulic fluid presents a significant fluid resistance to the returning piston 142 so as to regulate the speed of the return piston stroke and thus the corresponding movement of the associated traveling frames 24*a*, 24*b*.

A pressure and temperature compensated valve 158 in line 154 regulates the fluid pressure presented to piston 142 during the return stroke. Such compensation provides for a uniform flow of the fluid from cylinder 144 via line 154 to limit the speed of the return stroke of the piston 142. The check valve 156, however, permits essentially unrestricted flow of fluid from line 162 into the cylinder 144 via line 154 during the forward stroke of the piston 142. An overflow tank 160 completes the hydraulic system. Thus a closed fluid system with controlled and bypass fluid paths therein is provided to control the speed of collapsing movement of the substructure 20.

It is to be understood that while a certain form of this invention has been illustrated and described, it is not limited thereto, except insofar as such limitations are included in the following claims.

Having thus described the invention, what is claimed as new and desired to be secured by Letters Patent is:

1. An elevating substructure comprising:

a generally horizontally extending top frame adapted to support a load therein;

a ground-engaging base frame;

an intermediate support frame comprising a pair of separable generally horizontally extending traveling frames intermediate said top frame and base movable toward and away from each other, each of said traveling frames comprising a plurality of strut and beam members fitted and joined together to present a rigid skeletal structure;

linkage means intercoupling each of said traveling frames and said top frame and base frame for causing said top frame to shift upwardly to elevate the load or downwardly to collapse the substructure as said traveling frames undergo said respective movements toward and way from each other; and means connected with said traveling frames for driving the same toward each other into a side-by-side relationship to effect said upward shifting of said top frame to elevate the load; and means for releasably maintaining said pair of traveling frames in said side-by-side relationship to preclude separation of said traveling frames upon elevation of said load whereby to present said intermediate support frame to said upwardly shifted load.

2. The apparatus as claimed in claim 1, wherein said linkage means comprises:

pivot members extending between said base frame and each traveling frame and each traveling frame and said top frame; and means for mounting said respective pivot members between said respective frames in a manner to present a parallel motion among said respective frame members during said traveling frame movement.

3. The apparatus as claimed in claim 1, wherein said linkage means comprises:

a plurality of lower pivot legs extending between said base frame and each traveling frame;

a plurality of upper pivot legs extending between each traveling frame and said top frame; and means for mounting said lower and upper pivot legs to said respective frames in a parallel linkage relationship therebetween, said pivot legs operably responsive to said traveling frame movement to elevate or lower said associated frames in a parallel relationship therebetween.

4. The apparatus as claimed in claim 1, wherein said driving means comprises:

a first block assembly mounted to one of said traveling frames;

a second block assembly mounted to the other of said traveling frames;

a cable member for coupling said block assemblies to present a block and tackle operably associated with said traveling frames; and means for exerting a force on said cable for operating said block and tackle to effect said traveling frame movement in a direction to elevate said load.

5. The apparatus as claimed in claim 4, wherein said force exertion means comprises:

a block and tackle assembly associated with said load and including a cable member therein;

means for exerting a force on said cable associated with said load; and means for connecting said load cable to said cable of said driving means to provide for transfer of said force to said block and tackle of said driving means for operation of the same.

6. The apparatus as claimed in claim 5, wherein said load is an oil rig including an oil derrick with a block and tackle assembly thereon, said connecting means operably engaging said oil rig block and tackle to said block and tackle of said driving means to effect said traveling frame movement in said direction corresponding to elevation of said top frame with said oil rig thereon.

7. The apparatus as claimed in claim 6, further comprising:

a third block assembly; and means for mounting said third block assembly to said top frame with said cable of said driving means block and tackle associated therewith whereby to direct the free end of said driving means cable towards said block and tackle assembly associated with said load.

8. The apparatus as claimed in claim 1, further comprising:

a cylinder;

a piston slideable through said cylinder;

means for mounting said cylinder and piston to said traveling frames in movement therewith for sliding said piston through said cylinder in corresponding directions therethrough; and fluid valve means for presenting a fluid pressure to said piston during directional movement of said traveling frames corresponding to said collapse of said substructure whereby to control the speed of the same.

9. The apparatus as claimed in claim 1, wherein each traveling frame includes first and second laterally spaced-apart beam members moved into longitudinal alignment by said driving means with said maintaining means comprising means for locking the adjacent ends of said beam members one to the other.

10. The apparatus as claimed in claim 9, wherein said locking means comprises:

an aperture located in the adjacent end of each beam member;

means for aligning said apertures upon said longitudinal alignment thereof; and a pin member extending through said aligned apertures to preclude displacement of said beam members and their associated traveling frames.

11. The apparatus as claimed in claim 1, further comprising:

first and second laterally spaced-apart sway braces having lower and upper ends therein;

means for pivotally connecting said lower end of said sway brace to said base member;

means for pivotally connecting said upper end of each sway brace to the respective lateral sides of said top frame; and means for providing a swingable movement of said upper end of said sway brace between a first position adjacent said lower end to a second position vertically displaced therefrom in correspondence to the collapsed and elevated positions of said substructure with the sway braces axes of pivot positioned generally normal to the lateral axis of said top frame to preclude shifting of the same during movement between said collapsed and elevated positions.

12. The apparatus as claimed in claim 1, further comprising:

an aperture in said base frame for surrounding a wellhead;

a platform member on said top frame and in vertical alignment with said wellhead for receiving an oil derrick load thereon, said linkage means including structure therein for maintaining said vertical alignment of said oil derrick platform with said wellhead during said elevation of said oil derrick load.

13. The apparatus as claimed in claim 12, further comprising:

rail means extending along said base frame from the exterior thereof and towards said wellhead; and cart means engaging said rail means in slidable movement therealong for transport of materials to and from said wellhead area.

14. The apparatus as claimed in claim 1, further comprising means for biasing said traveling frames in a direction to cause said top frame to shift downwardly and to collapse said substructure.

15. The apparatus as claimed in claim 14, wherein said bias means is presented by the geometry of said linkage means being swingably responsive to said load thereon in a direction to cause said top frame to shift downwardly and to collapse said substructure.

16. A lift for an oil derrick load comprising:

a base frame;

a bifurcated support frame having first and second separable traveling frame members therein;

a first pivot means for mounting each traveling frame to said base frame in swingable movement relative thereto between a first position with said traveling frames adjacent said base frame to a second position with said traveling frames elevated from base frame and contiguously adjacent one to the other with an end of said first traveling frame abutting an end of said second traveling frame;

a top frame;

a second pivot means for mounting said top frame to said traveling frames in vertical movement responsive to said traveling frame movement between a first position adjacent said traveling frames to a second position vertically displaced therefrom upon said movement of said traveling frames to said contiguously adjacent relationship;

means for releasably connecting said pair of traveling frames in said second position to preclude separation of said traveling frames and movement of the same to said first position whereby to present said support frame intermediate said top and base frames;

means in said base frame for presenting an access to the wellhead of an oil well;

a derrick receiving platform on said top frame and positioned in vertical alignment with said wellhead aperture;

drive means for effecting traveling frame movement between said first and second positions to elevate said top frame with said derrick load thereon said first and second pivot means including structure for maintaining said alignment between said derrick platform and wellhead aperture during said traveling frame movement whereby to preclude longitudinal and lateral shifting of said derrick load during elevation of the same.

17. The apparatus as claimed in claim 16, wherein said pivot means structure presents a parallel linkage structure intercoupling said base, traveling and top frames for maintaining a parallel relationship therebetween during said respective frame movement.

18. The apparatus as claimed in claim 16, wherein said drive means comprises:

a block and tackle associated with said oil derrick;

means for operably engaging said block and tackle of said oil derrick with said traveling frames in a manner whereby said oil derrick block and tackle effects a mechanically advantageous movement of said traveling frames and elevation of said top frame with said oil derrick thereon.

19. In combination with an oil derrick having a block and tackle assembly therein, an elevating substructure comprising:

a generally horizontally extending top frame adapted to support said oil derrick thereon;

a ground-engaging base;

a pair of generally horizontally extending traveling frames intermediate said top frame and base and movable horizontally toward and away from each other, each of said traveling frames comprising a plurality of strut and beam members fitted and joined together to present a rigid skeletal structure;

linkage means intercoupling each of said traveling frames and said top frame and base for causing said top frame to shift upwardly to elevate the oil derrick or downwardly to collapse the substructure as said traveling frames undergo said movement; and means operably engaging said traveling frames with said block and tackle for driving the traveling frames in a direction to effect said upward shifting of said frame whereby said oil derrick operates said substructure to elevate its own load.

20. An elevating substructure comprising:

a generally horizontally extending top frame adapted to support a load thereon;

a ground-engaging base frame;

a pair of generally horizontally extending traveling frames intermediate said top frame and base frame and movable toward and away from each other;

linkage means intercoupling each of said traveling frames and said top frame and base frame for causing said top frame to shift upwardly to elevate the load or downwardly to collapse the substructure as said traveling frames undergo said movement;

means connected with said traveling frames for driving the same in a direction to effect said upward shifting of said top frame to elevate the load;

a cylinder;

a piston slidable through said cylinder;

means for mounting said cylinder and piston to said traveling frames in movement therewith for sliding said piston through said cylinder in directions therethrough corresponding to said traveling frame movement; and fluid valve means for presenting a fluid pressure to said piston sliding through said cylinder during movement of said traveling frames in a direction corresponding to said collapse of said substructure whereby to control the speed of said movement of said traveling frames.

21. An elevating substructure comprising:

a generally horizontally extending top frame adapted to support a load thereon;

a ground-engaging base frame;

a pair of generally horizontally extending traveling frames intermediate said top frame and base frame and movable toward and away from each other;

linkage means intercoupling each of said traveling frames and said top frame and base frame for causing said top frame to shift upwardly to elevate the load or downwardly to collapse the substructure as said traveling frames undergo said movement;

means connected with said traveling frames for driving the same in a direction to effect said upward shifting of said top frame to elevate the load;

means for maintaining said traveling frames in said adjacent relationship to present a joined bifurcated frame offering intermediate support to said elevated load; and wherein each traveling frame includes first and second laterally spaced-apart beam members moved into longitudinal alignment by said driving means with said maintaining means comprising means for locking the adjacent ends of said beam members of each traveling frame one to the other.

22. The apparatus as claimed in claim 21, wherein said locking means comprises:

an aperture located in the adjacent end of each beam member;

means for aligning said aperture upon said longitudinal alignment of said beams; and a pin member extending through said aligned apertures to preclude displacement of said beam members and their associated traveling frames.

23. An elevating substructure comprising:

a generally horizontally extending top frame adapted to support a load thereon;

a ground-engaging base frame;

a pair of generally horizontally extending traveling frames intermediate said top frame and base frame and movable toward and away from each other;

linkage maans intercoupling each of said traveling frames and said top frame and base frame for causing said top frame to shift upwardly to elevate the load or downwardly to collapse the substructure as said traveling frames undergo said movement;

means connected with said traveling frames for driving the same in a direction to effect said upward shifting of said top frame to elevate the load;

first and second laterally spaced-apart sway braces having lower and upper ends therein;

means for pivotally connecting said lower end of said sway brace to said brace member;

means for pivotally connecting said upper end of each sway brace to the respective lateral sides of said top frame; and means for providing a swingable movement of said upper end of said sway brace between a first position adjacent said lower end to a second position vertically displaced therefrom in correspondence to the collapsed and elevated positions of said substructure with the sway braces axes of pivot positioned generally normal to the lateral axis of said top frame to preclude shifting of the same during movement between said collapsed and elevated positions.

24. The apparatus as claimed in claim 23, wherein said sway braces comprise:

lower and upper frame members each having first and second spaced apart ends with said second end of said lower frame member presenting said lower end of said sway brace and said second end of said upper frame member presenting said upper end of said sway brace; and means for pivotally connecting said first end of said frame members about a common pivot axis whereby to provide movement of said second ends of said frame members toward and away from each other in correspondence to the collapsed and elevated positioning of said substructure whereby to present said swingable movement means.

* * * * *